United States Patent [19]

Trimborn

[11] Patent Number: 4,817,265

[45] Date of Patent: Apr. 4, 1989

[54] METHOD FOR THE MANUFACTURE OF A CONTROL DISC OR A CONTROL SHIELD FOR A LIQUID-RING MACHINE

[75] Inventor: Peter Trimborn, Nuremberg, Fed. Rep. of Germany

[73] Assignee: Siemens Aktiengesellschaft, Mynchen, Fed. Rep. of Germany

[21] Appl. No.: 34,142

[22] Filed: Apr. 2, 1987

[30] Foreign Application Priority Data

May 23, 1986 [DE] Fed. Rep. of Germany ..... 3617344

[51] Int. Cl.[4] ..... B23P 17/00

[52] U.S. Cl. ..... 29/527.6; 29/251.4 R; 29/156.4 WL; 415/149 R

[58] Field of Search ..... 29/126, 527.6, 509, 29/516, 156.4 R, 156.4 WL; 415/148, 150, 151, 149 R, 149 A

[56] References Cited

U.S. PATENT DOCUMENTS 3,988,079 10/1976 Ounsted et al. ..... 29/156.4 R
4,050,132 9/1977 Wieland ..... 29/156.4 WL X
4,550,645 11/1985 Beck, Jr. ..... 29/156.4 R X

OTHER PUBLICATIONS

NMA 3308 DE Operating Instructions for the Siemens Type 2BB Vacuum Pump.
Three Production Drawings (S83 4287, S83 0160 and S83 8113) for the Siemens Type 2BB Pump.

*Primary Examiner*—Carl J. Arbes
*Attorney, Agent, or Firm*—Kenyon & Kenyon

[57] ABSTRACT

A first control disc or plate part of a liquid ring machine referred to herein as a bearing disc, is cast or, more particularly, burned-out of ordinary steel without an end face wall but having an outer circular edge and partitions within the circular outer edge. The outer circular edge and partitions of the bearing disc are ground off so that edges of a front side facing the liquid ring lie in one plane. This bearing disc is then welded to a second separately fabricated flat cover disc of alloy steel, into which cover disc, suction and pressure slots, an operating liquid passage, and a shaft opening have been previously formed, the alloy steel cover disc forming the end face wall of the bearing disc.

2 Claims, 2 Drawing Sheets

METHOD FOR THE MANUFACTURE OF A CONTROL DISC OR A CONTROL SHIELD FOR A LIQUID-RING MACHINE

BACKGROUND OF THE INVENTION

The invention relates to the field of manufacturing a control disc or a control plate for a liquid-ring machine and, more particularly, to the economical manufacture of such a control disc or plate for withstanding corrosive media.

Electric machines known in the art as liquid ring machines generally are employed as pumps for a gaseous medium. A housing for such a pump surrounds a ring of rotating liquid which is caused to rotate by an eccentrically mounted vane wheel turned by a revolving shaft. The shaft, in turn, is supported at each end in an end bell having inlet and outlet ports for the gaseous medium to be pumped as well as at least one inlet for operating liquid which replenishes any liquid lost, for example, through evaporation into the pumped medium. Because of the eccentric mounting of the vane wheel, operating liquid on one side Of the vane wheel creates a suction zone in which zone the pumped gaseous medium is sucked into the pump by way of the inlet ports in the end bells. On the other side of the eccentrically mounted vane wheel, a pressure zone is created where the pumped gaseous medium is forced to exit the pump by way of the outlet ports in the end bells.

Between the end bells and the vane wheel housing or comprising a part of the end bell itself is a control disc or plate which partitions the end bell into separate chambers for operating liquid and pumped gaseous medium as well as provides control openings for the entry and exit of both operating liquid and gaseous medium. The control disc is typically sealed with the end bell on one side and seals the housing on the other side. At the same time, the control disc is designed to comprise separate pressure and suction slots in an end face wall facing the liquid ring for the pumped gaseous medium, the pressure and suction slots being concentrically arranged outside a hub of the vane wheel. Also, an opening for operating liquid is typically arranged in the vicinity of the vane wheel hub so that the operating liquid further fulfills the function of a gap sealing liquid sealing the gap between the vane wheel hub and the control disc.

In known methods of manufacture of such control discs, at least one of the two end bells is designed as including a side shield abutment with inlets and outlets for a medium to be transported as Well as with connections for supplying cooling and gap-sealing operating liquid. Also, between the side shield abutment and the housing, a control disc with suction and pressure slots on its end face (facing the liquid ring) as well as at least one passage for the operating liquid through the end face wall is provided, where the various openings in the end face wall Of the control disc facing the liquid ring are further in communication with chambers bounded between the side shield abutment and the control disc by means of partitions on the back of the control disc and/or in the side shield abutment of the end bell.

It is further known from the manufacture of liquid-ring machines such as the Siemens type 2BB to combine the control disc and the side shield abutment to form a structural unit referred to hereinafter as a control plate.

Both control discs and control plates are commonly cast of steel in expensive molds where the end face wall must be relatively thick because of the requirements of casting processes of present foundry technology. In addition, the outside surface of the end face wall facing the vane wheel must be machine planed smooth and the edges of the openings must be deburred and brought to accurate dimensions in order to obtain a uniform gap width between the end face wall and the vane edges of the vane wheel to permit a flow through the openings of the end face wall that is as undisturbed as possible.

With more corrosive media, increased corrosion occurs when ordinary steel is employed for constructing the end face wall at the openings. Such corrosion leads to a premature, noticeable degradation of the efficiency of such machines because of increased gap losses and disturbed flow conditions through the openings in the end face wall.

For such aggressive media, control discs made of substantially more expensive corrosion resistant steel alloys are known, either manufactured by a casting process or by burning-out the spaces and openings from a correspondingly thick-walled alloy steel plate, the latter method resulting in a considerable loss of expensive material.

In cast control plates for withstanding a corrosive medium of the Siemens type 2BB, a relatively thin-walled alloy steel cover disc with preformed openings is typically screwed on to an end face wall of a pre-cast steel side shield abutment after a chip-removing machining of the outside surface of the end face wall and preforming a circular edge in the cover disc. Also, the space between the outer circumference of the end face wall and the circular edge of the cover disc is typically cast with hardenable casting resin so that no corrosive medium can get between the cover disc and the cast end face wall.

With this Siemens control shield, the edges of the aligned openings in the end face wall and in the cover disc must be reworked together in a final operation.

Thus, it is desirable to provide a method of manufacture of a control disc or a control plate for a liquid-ring machine for withstanding more corrosive media which results in a lower cost for material and a greater simplicity of manufacture and obtains practically the same service life for the control disc or plate obtained with the designs cast wholly of corrosion resistant steel alloy, or designs made using a burn out process.

SUMMARY OF THE INVENTION

A successful solution of the stated problem is possible through a manufacturing method according to the features of the present invention in a particularly simple Way, where the burning-out operation is of lower cost, especially since in the casting process as well as in the burning-out process, it is not necessary to cast an especially thick end face wall or to submit the disc or shield to an excessive burning-out operation.

In particular, the method according to the present invention includes the steps of forming a bearing disc of ordinary steel having a circular edge and partitions within the perimeters of the circular edge including a circular support for the vane wheel shaft, grinding off a side of the bearing disc facing the liquid ring so that the circular edge and partitions lie in one plane, forming a flat plate cover disc of steel alloy with openings for the suction and pressure slots, the operating liquid passage and the vane wheel shaft, and welding the flat plate cover disc to the ground off side of the bearing disc such that the cover disc forms the end face wall of the thus fabricated control disc or plate.

The manufacture of the control disc or plate is thus accomplished more simply and economically by a casting and burning-out method since the expenditures in previously known processes for providing a facing and chip-removing machining of the surface of the end face wall facing the liquid ring, for casting a circular edge with hardenable synthetic resin or for a final step of reworking all the openings after the end face wall and disc are aligned can be eliminated.

DETAILED DESCRIPTION OF THE DRAWINGS

The following description of a double flow liquid-ring machine applies logically also to a single-flow design of such a machine.

Figure 1:
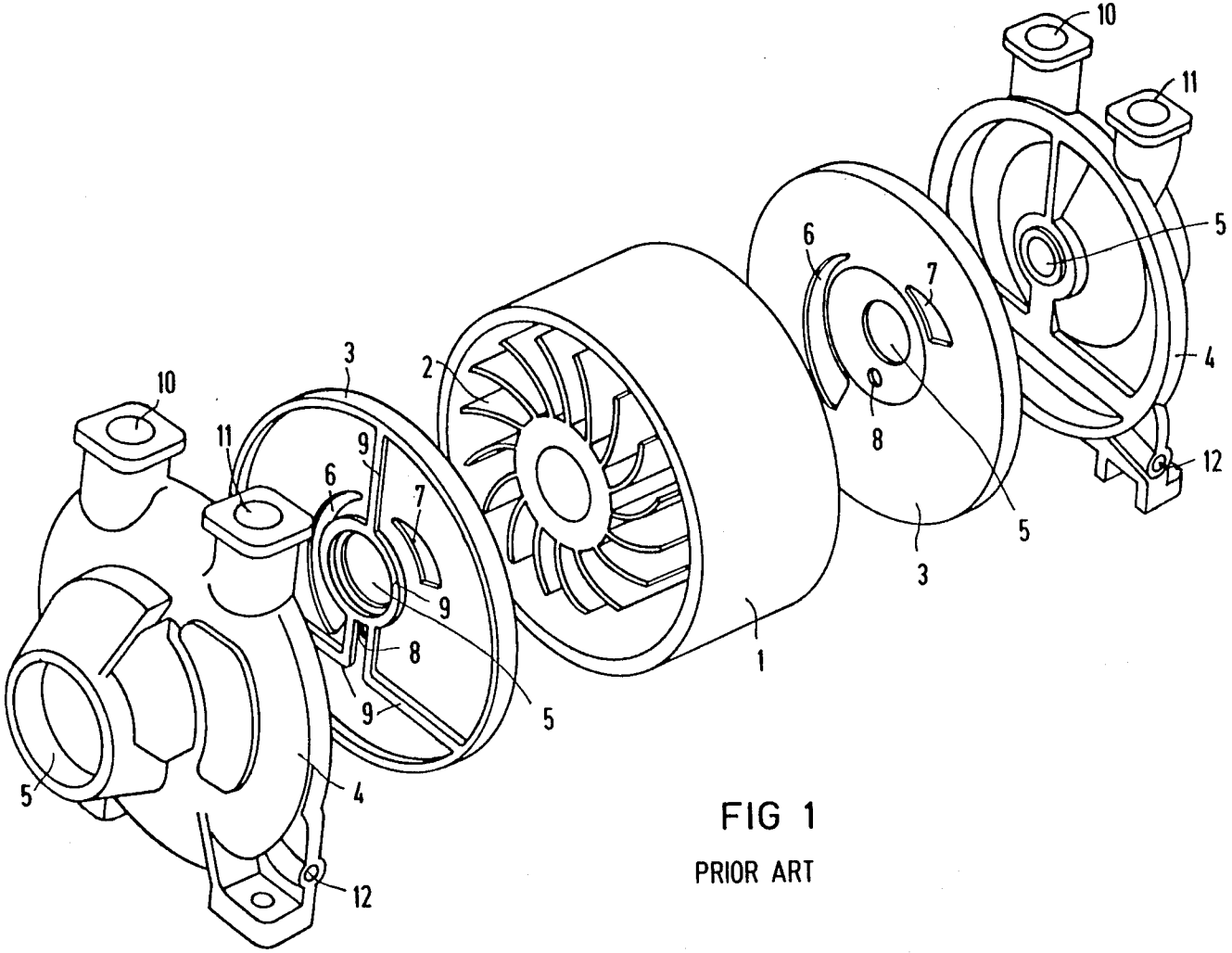
FIG 1 PRIOR ART
FIG. 1 is a general View of a typical double-flow liquid-ring machine in accordance with teachings of the prior art.

Referring to FIG. 1, a typical liquid ring machine is shown in accordance with teachings of the prior art for a double flow design. The housing 1 with a vane wheel 2 arranged eccentrically therein is covered on both sides by a control disc 3 and each control disc is covered by a side shield abutment 4, in the depicted example, comprising a portion of an end bell.

The vane wheel shaft, not shown, goes through a shaft opening 5 in each control disc 3 as well as through an opening in the side shield abutments and is supported at the ends in the two side shield abutments 4. The control discs 3 furthermore each have in their end face wall facing the liquid ring a suction and pressure slot 6 and 7, respectively, as well as a passage 8 for operating liquid. On their respective back sides facing the side shield abutments, partitions 9 are provided. The side shield abutments 4 each have an inlet and outlet 10, 11 for a medium as well as an inlet 12 for the operating liquid. Instead of the usual separate design shown of the control disc and adjacent end bell, a control plate of unitary design can also be provided.

In the Siemens 2BB type cast structural control plate, not shown, a separate corrosion resistant steel alloy cover disc including suction and pressure slots and the operating-liquid passage is screwed on to an end face wall of a side shield abutment with correspondingly similar openings. Any unwanted gaps between the end face wall and the cover disc are sealed by casting resin. The following described method of manufacture may be applied in the manufacture of such a control plate as well as to the manufacture of a control disc.

Figure 2:
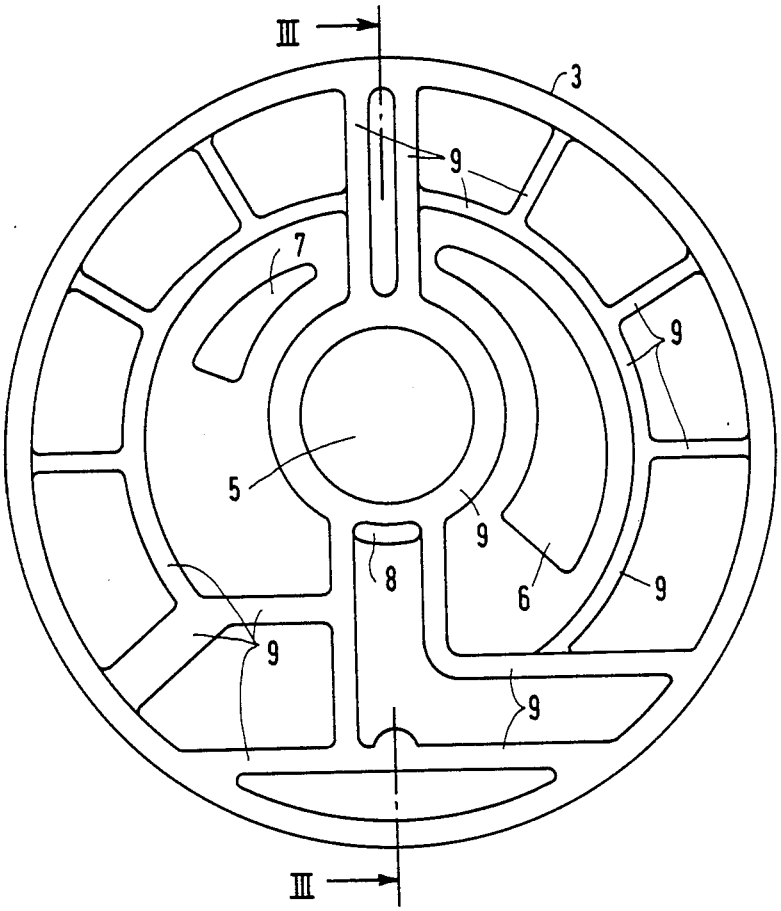
FIG. 2 is a top view of a control disc or plate manufactured according to the invention as seen from the back side facing an end bell.
Figure 3:
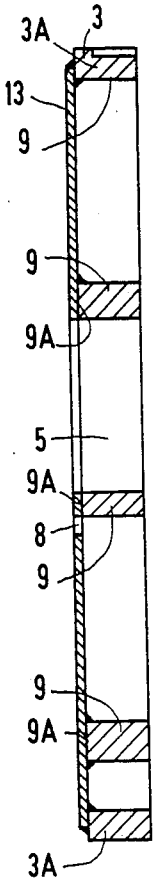
FIG. 3 is a side view of a control disc or plate manufactured according to the invention, showing a section through the control disc or plate according to FIG. 2 along the axis III—III.

In FIGS. 2 and 3, a partial control disc 3 or plate cast of ordinary steel or, in particular, by being burned out without an end face wall formed by cover disc 13 according to the present invention is shown. The partial disc 3 may be hereinafter described as a bearing disc since it comprises partitions for chambers including a circular bearing partition for supporting the shaft of the vane wheel. A separately fabricated flat cover disc 13 made of corrosion resistant steel alloy is welded to a front side of the bearing disc facing the vane wheel as shown in a side view along a section III—III of FIG. 2 as depicted in FIG. 3. From FIG. 2, it can be seen that the relatively thin-walled cover disc 13 has punched, milled or burned-out openings (suction and pressure slots 6 and 7, respectively; operating liquid passage 8, and shaft opening 5). With respect to the bearing disc 3, the end faces 9A of the partitions 9 and end faces of the circular edge 3A are ground off on the front side to lie in one plane. Referring further to FIG. 3, it can be seen that end faces 9A of the partitions 9, and the end faces of the circular edge 3A of the control disc part 3 are then welded to the alloy steel cover disc 13. The shaping of the partitions 9 and thereby of the rear chambers in the end bell separated from each other is performed in a manner known per se, depending on the required operating conditions of the control disc or plate. The chambers formed by the partitions 9 are covered by the cover disc 13.

What is claimed is:

1. A method for the manufacture of a control disc or plate for a liquid-ring machine including a vane wheel adapted to be rotated by a rotating shaft, the control disc or plate having an end face wall with front side facing a liquid ring and a back side, suction and pressure slots on the front side of the end face wall, a shaft opening and at least one passage for operating liquids extending through the end face wall and partitions forming chambers on the back side of the end face wall comprising the steps of:

forming a bearing disc of ordinary steel having a circular outer edge and partitions within the perimeter thereof including an open cylindrical support for the vane wheel shaft and no end face wall, grinding off the front side of the circular edge and the front sides of the partitions of the bearing disc so as to lie in one plane, forming a flat cover disc of corrosion resistant steel alloy with the suction and pressure slots, the shaft opening corresponding to the open cylindrical vane wheel shaft support of the bearing disc and the passage for operating liquids, and welding the flat cover disc to the ground-off front sides of the circular edge and partitions of the bearing disc.

2. A method in accordance with claim 1 wherein the forming of the bearing disc particularly comprises the steps of casting the bearing disc and burning out spaces between the circular outer edge and the partitions.

* * * * *